US005116007A

United States Patent [19]

Von Gunton et al.

[11] Patent Number: 5,116,007

[45] Date of Patent: May 26, 1992

[54] ECCENTRIC DISC LOCK BRACKET

[75] Inventors: Lee L. Von Gunton, Buffalo Grove; Glen C. Hook, Libertyville, both of Ill.

[73] Assignee: E.Z. Shelf Company, Buffalo Grove, Ill.

[21] Appl. No.: 582,654

[22] Filed: Sep. 13, 1990

[51] Int. Cl.[5] ..... E04G 3/08

[52] U.S. Cl. ..... 248/243; 108/108; 248/231.3

[58] Field of Search ..... 248/243, 231.3, 222.1, 248/244, 245, 250; 211/187; 108/144, 111, 108

[56] References Cited

U.S. PATENT DOCUMENTS

| | | | |
|---|---|---|---|
| D. 43,446 | 1/1913 | Warner . | |
| D. 244,221 | 2/1988 | Sheftel . | |
| D. 254,290 | 2/1980 | Smith . | |
| 941,682 | 11/1909 | Knape | 248/243 |
| 977,609 | 12/1910 | Freeman | 248/243 |
| 1,283,964 | 11/1918 | Taussig | 248/243 |
| 1,974,050 | 9/1934 | Keil | 248/243 |
| 2,534,952 | 12/1950 | Comer . | |
| 3,114,531 | 12/1963 | Weber . | |
| 3,273,847 | 9/1966 | Berman | 248/243 |
| 3,353,684 | 11/1967 | Chesley | 248/243 |
| 3,358,956 | 12/1967 | Thornton . | |
| 3,572,626 | 3/1968 | Bertschi | 248/242 |
| 3,601,432 | 8/1971 | Fenwick et al. | 287/189.36 |
| 3,697,034 | 10/1972 | Shell | 248/243 |
| 4,018,167 | 4/1977 | Spangler . | |
| 4,098,480 | 7/1978 | Neumann | 248/243 |
| 4,133,433 | 1/1979 | Wolf | 211/192 |
| 4,171,789 | 10/1979 | Vander Hoek et al. | 248/243 |
| 4,324,379 | 4/1982 | Ovitz, III | 248/222.1 |
| 4,387,872 | 6/1983 | Hogue | 248/221.3 |
| 4,455,007 | 6/1984 | Varon et al. . | |
| 4,716,699 | 1/1988 | Crossman et al. | 248/243 X |
| 4,775,125 | 10/1988 | Pfeifer | 248/243 X |
| 4,805,863 | 2/1989 | Armstrong et al. . | |
| 4,828,122 | 5/1989 | Day . | |
| 4,836,484 | 6/1989 | Reed . | |
| 4,881,708 | 11/1989 | Walter . | |

FOREIGN PATENT DOCUMENTS

| | | | |
|---|---|---|---|
| 1181590 | 2/1970 | United Kingdom . | |
| 8800580 | 9/1988 | World Int. Prop. O. | 248/231.3 |

OTHER PUBLICATIONS

Webster's Ninth New Collegiate Dictionary.

*Primary Examiner*—Carl D. Friedman
*Assistant Examiner*—Korie Chan
*Attorney, Agent, or Firm*—James P. Hanrath

[57] ABSTRACT

An eccentric disc lock bracket for releasable engagement with a support member having a plurality of vertically spaced slots comprises an eccentric disc lock and a cantilever bracket including an end portion having an axle receiving aperture and a pair of seating hooks outwardly extending from a rear edge of the end portion vertically positioned one above the other and dimensioned to be receivable into a pair of vertically spaced slots of the support member. The bracket is locked to the support member by an eccentric disc lock having an axle and a pair of wheels axially aligned to each other of essentially alike diameter on opposite ends of the axle spaced apart from each other a distance greater than the thickness of the cantilever bracket. The axle is positioned is an axle receiving aperture of the end portion of the bracket and may be retained therein by a retention nub on the outer periphery of the receiving aperture. At least one wheel has a groove, indentation, or turning knob about its outer side surface to turn the eccentric disc lock in either clockwise or counter-clockwise direction to a locked position wherein a portion of the outer annular aligned periphery of each wheel extends outwardly beyond the rear edge of the bracket end portion to compressingly engage the support member and to an unlocked position wherein another portion of the outer annular aligned periphery of each wheel does not extend outwardly beyond the rear edge of the bracket end portion when disposed perpendicular to the support member. The axle of the eccentric disc lock has a diameter eccentric to the diameter of the pair of wheels.

23 Claims, 5 Drawing Sheets

PRIOR ART

ECCENTRIC DISC LOCK BRACKET

BACKGROUND OF THE INVENTION

1. Field of the Invention

The present invention is related to shelf brackets, racks, hangers, and other cantilevered members mounted to an upright support and the like used in homes for books, ornamental objects, and other things and used in stores for displaying various types of articles, and more particularly, to a eccentric disc lock bracket.

2. Description of the Related Art including Information Disclosed under 37 CFR Sections 1.97–1.99

A common form of shelving structure used to support commercial merchandising displays as well as home decor arrangements utilize cantilevered bracket members mounted on vertical support members. The vertical members may be in the form of slotted standards mounted on a wall or free-standing slotted columns affixed to the floor and ceiling. Such support members are typically provided with a plurality of vertically spaced slots dimensioned to receive seating hooks of a bracket in interlocking engagement with said support members in a cantilevered fashion.

Although some bracket/wall standard systems are designed to be permanent installations, the changing merchandising display needs of commercial users as well as the decor arrangements of home users make it desirable that the brackets be able to be changed and rearranged between multiple positions in the support members with relative ease and economy and without damaging the finish thereof. Accordingly, ease of installation, flexibility of bracket settings, portability, secure engagement of the bracket to support member, ease in disengagement, as well as the cost and ornamental or sightliness appearance of the bracket are important factors in modern integrated merchandising, storage, and home decor shelving units.

Due to a variety of factors there is a tendency for the interlocking bracket seating hooks and vertical support members to loosen and move relative to one another. For example heavy loading of a shelving unit may tend to uncouple the bracket from the upright, especially wherein a particular bracket is used to form a pedestal at the base of an upright to make a free-standing shelving unit since the forces acting on the bracket leg member are opposite to the usual loading forces. Further, a seating hook may be installed to an upright support incompletely in a partially seated position resulting in a bracket engagement failing to bear its normal stress load. Even proper installation of certain bracket seating hooks may have a shearing effect on the wall standard damaging its structural integrity. Also, bracket members are capable of being accidentally dislodged. It is desirable for these and other reasons to have the bracket member locked to the upright support member to prevent such inadvertent separation.

The prior art discloses a variety of approaches to securely mount a bracket member to an upright support member. For example, the U.S. Pat. No. 3,353,684 to Chesley utilizes a certain bracket hook member which defines an angular slot with an inclined portion which diverges downwardly and away from the end of the bracket member. This hook member when inserted into the slotted opening of an upright support can receive different thicknesses of metal for engagement on different types of upright supports as the engagement takes place at a point on the inclined portion of the hook member which engages the inner wall of the upright support member. This particular hook configuration (which is illustrated at FIG. 2) is combined with a vertically adjustable locking arm member designed to extend into and fill a slot of the upright support. This particular arrangement is disadvantageous for two reasons. First, the inner angled edge of the hook member is designed to be typically installed by hammer force-fitting such that the tapered edge is in "pinched" engagement with the inner surface of the upright support member. Hammer blows can scar the finish or color coating of either the bracket or support member and force-fitting causes the interior angled edge of the hook member to shear or damage the interior surface of the wall standard thereby endangering its structural integrity. Second, usage of a locking arm extending into a slot of the upright support requires filling of the remaining space of a seating hook receiving slot or yet another slot and may further detract from the ornamental attractiveness of the bracket shelving structure.

U.S. Pat. No. 4,324,379 to Ovitz III discloses a horizontally slidable lock ear which projects into a slot of the upright support member adjacent to the top edge of the slot to prevent vertical movement which could release a bracket hook from the slot.

Other United States Patents teach a support slot based lock in conjunction with spring or screw mechanisms. For example, U.S. Pat. No. 3,697,034 to Shell teaches a spring biased bar pivoted at one end of the bracket member which springs outward into one of the receiving slots of the upright support member upon completion of the assembly of the two members. Thus, a locking of the bracket to the support occurs with a lug type filling of the support member receiving slot above the mounted seating hook member. This type of locking is also illustrated in U.S. Pat. No. 4,133,433 to Wolf which discloses a special locking plunger to fill the support member receiving slot above a seating hook member with the aid of a screw mechanism. In U.S. Pat. No. 4,387,872 to Hogue a spring is used to urge a plunger to fill the support member receiving slot above a seating tab of the hook member. In U.S. Pat. No. 3,601,432 to Fenwick a pivotally mounted locking arm provides for a tab portion to be inserted into the space remaining in a support slot after the hook is inserted therein.

In U.S. Pat. No. 3,572,626 to Bertschi there is disclosed an adjustable bracket member capable of being engaged and locked in two or more selected orientations to the vertical support member by specifically shaped retaining lug formations of close tolerances and a shaped locking member having a cam surface for each of the positions of the bracket to urge the lug formations into firm engagement with the vertical support member. The locking member 30 is preferably a bifurcated element composed of a shaft 32 and plate portions 34 carried on either end of the shaft. The bracket member has a notch or hole disposed between the two retaining lugs of the bracket which receives the shaft portion of the lock element and positions the plate portions on either side of the bracket body. The lock member 30 is installed on the bracket by merely sliding it in through an open end of the notch 36 in the bracket. Each of the two matching plate portions 34 of the lock element 30 has a cam surface for each of two positions of the bracket. Each of the plate portions 34 of the lock members has a projection 38 which can be grasped by the user for purposes of moving the locking member such that the cam surfaces wedgingly engage the vertical member when the bracket is in one of its selected orientations.

SUMMARY OF THE INVENTION

According to the invention, there is provided an eccentric disc lock bracket for releasable engagement with a support member having a plurality of vertically spaced slots comprising: a cantilever bracket including an end portion having an axle receiving aperture and at least two seating hooks outwardly extending from a rear edge of the end portion vertically positioned one above the other and dimensioned to be receivable in and horizontally removable from a pair of vertically spaced slots of the support member; an eccentric disc lock having an annular axle which is force fitted over an interference retention nub on the outer periphery of the axle receiving aperture to thereby permanently retain the axle in the axle receiving aperture of the bracket end portion for all 360 degrees of rotational positions of the axle when so force fitted over the retention nub thus preventing removal or loss of the eccentric disc lock from the axle receiving aperture of the bracket end portion and causing the eccentric disc lock to be unitary with the cantilever bracket, the axle capable of being unidirectionally rotated in clockwise or counter-clockwise direction to achieve a lock position and a pair of wheels axially aligned to each other having an essentially alike diameter greater than the diameter of said axle receiving aperture, the wheels being located on opposite ends of the axle spaced apart from each other a distance greater than the thickness of the cantilever bracket, at least one wheel having means for rotating the eccentric disc lock either in a clockwise or counter-clockwise direction, such as a groove to its outer surface of sufficient width and length to have the side edge of a coin inserted therein for the purpose of rotating, to a lock position wherein a portion of the outer annular aligned periphery of each wheel extends outwardly beyond the rear edge of the end portion of the bracket to compressingly engage the support member and to an unlocked position wherein another portion of the outer annular aligned periphery does not extend outwardly beyond the rear edge of the end portion of the cantilever bracket when disposed perpendicular to the support member, the axle having a diameter eccentric to the diameter of the pair of wheels.

In a preferred embodiment of the present invention, each of the pair of axially aligned wheels of the eccentric disc lock further includes a notch in its outer annular aligned periphery adjacent and axially aligned to the other. The notches do not extend outwardly beyond the rear edge of the end portion of the cantilever bracket when positioned perpendicular to the support member thus providing an instant visual reference to the bracket user that the eccentric disc lock in an "unlocked" position when so orientated to the support member. When the eccentric disc lock is rotated in clockwise or counter-clockwise direction to a "lock" position the notches no longer are perpendicular to the support member thereby again providing an instant visual reference to the bracket user of the "lock" position.

The embodiments of the present invention advantageously provide for an eccentric disc lock bracket with improved ease of releasable secured installation into a support member and disengagement therefrom without force fitting, special tools, or scarring, chipping, and other damage to the finish or color coating of either the cantilever bracket or support member. The eccentric disc lock bracket of the present invention further avoids a shearing affect on the support member due to angled edge seating hooks and does not require specifically shaped seating hook formations of close tolerances. Secure locking of the cantilever bracket to a support member takes place without an unsightly locking arm extension having to be placed into one or more slots of the support member. The eccentric disc lock has an ornamentally pleasing appearance important in fulfilling home storage and commercial display bracket shelving needs. The eccentric disc lock in all embodiments efficiently converts over 300 degrees of torque rotation to horizontal clamping force accommodating a wide variety of support member bracket facing plate thicknesses.

Additional features and advantages of the present invention will become apparent to those skilled in the art from the following description and accompanying figures illustrating the preferred embodiment of the invention, the same being the present best mode for carrying out the invention.

BRIEF DESCRIPTION OF THE DRAWINGS

The foregoing and other features of the present invention will be more fully understood after reading the following description which refers to the illustrative exemplary embodiments shown in the accompanying drawings herein.

DESCRIPTION OF THE PREFERRED EMBODIMENT

Figure 1:
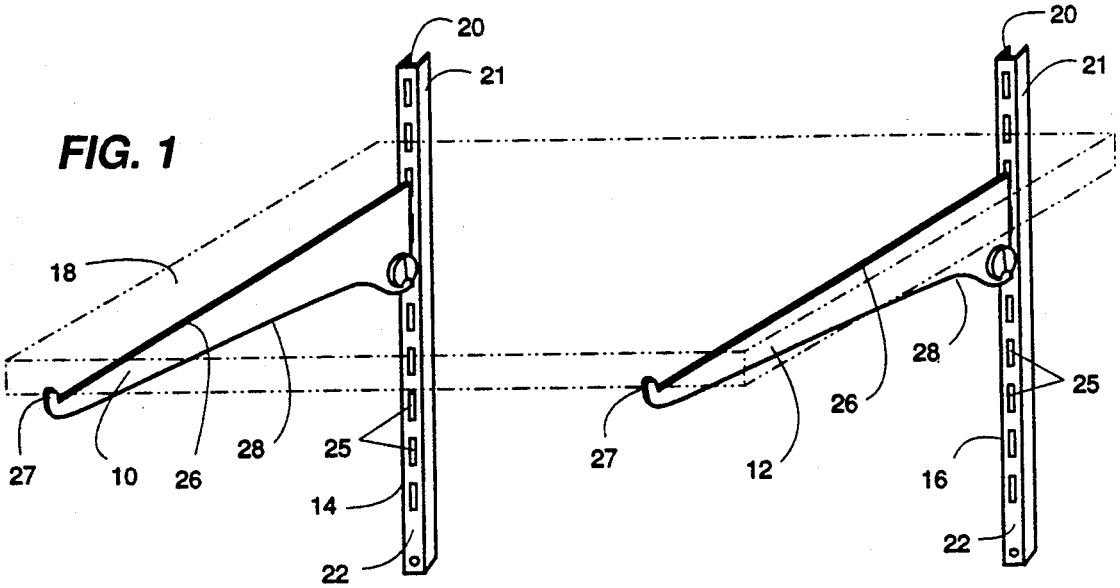
FIG. 1 is a perspective view of two cantilever bracket arms constructed according to the teachings of the present invention and two vertical support members in adjacent alignment with each other illustrating a phantom board being supported thereon.

Referring now to the drawings, and more particularly to FIG. 1, there is shown a perspective view of brackets 10 and 12 of the present invention engaged in vertical support members 14 and 16, to support shelf board 18 (shown in phantom). Each bracket is a unitary piece of uniform thickness preferably stamp pressed or die punched from sheet metal or other substantially rigid material. It is specifically noted that it is the mounting end portion of the cantilever bracket that is pertinent to the patent disclosure herein as it will be readily apparent to those skilled in the art that various modifications to the body portion of the cantilever bracket may be made to adapt it to purposes other than supporting shelves. Particularly, the body of brackets 10 and 12 need not be a simple plate but can be a member shaped appropriately to support various forms of articles by including flanges, notches, or apertures or other desired formations for particular purposes. For example, the body of brackets 10 and 12 may have an aperture for the purpose of supporting one end of a rod for purposes of hanging display merchandise or clothing.

The two vertical support members 14 and 16 are channeled sections having side extensions 20 and 21 joined together by a bracket facing plate 22. The two vertical support members 14 and 16 are identical and are joined to a wall or other surface (not illustrated) by rivet, screw, or other appropriate means such that they are oriented to parallel each other and be at or near a right angle to the seating hooks of the cantilever brackets. Bracket facing plate 22 of the vertical support members is formed with a plurality of uniform vertically spaced receiving slots 25 dimensioned to receive seating hook members of a cantilever bracket at any desired vertical level. The vertical support members when properly mounted in vertical orientation parallel to each other have the receiving slots 25 of the bracket facing plate 22 axially aligned across from each other such that each receiving slot is complimentary adjacent and cooperates with its corresponding counterpart. FIG. 1 illustrates such a proper installation however, faulty installation may result in a receiving slot of one bracket facing plate not being fully axially aligned across from the other in which case it is desirable for the cantilever bracket arm to have means for locking its seating hook members thereof to the improperly aligned vertical support in a non "fully seated" position. Further, the illustrated vertical support members are one of a variety of suitable support members, it being understood by those skilled in the art that a support member may have other geometrical shapes such as tubular, round, or oval, may be of free-standing form which is attached between a floor and ceiling or supported in some other suitable way, may be suitably supported in a horizontal orientation, and also may have bracket receiving slots in the front, sides, or rear thereof. Suitable support members are usually made of sheet metal of varying thicknesses and of different cross sectional configurations. It is therefor necessary to provide brackets capable of seating into the receiving slots of such support members regardless of the thickness or configuration of the support members.

Figure 3:
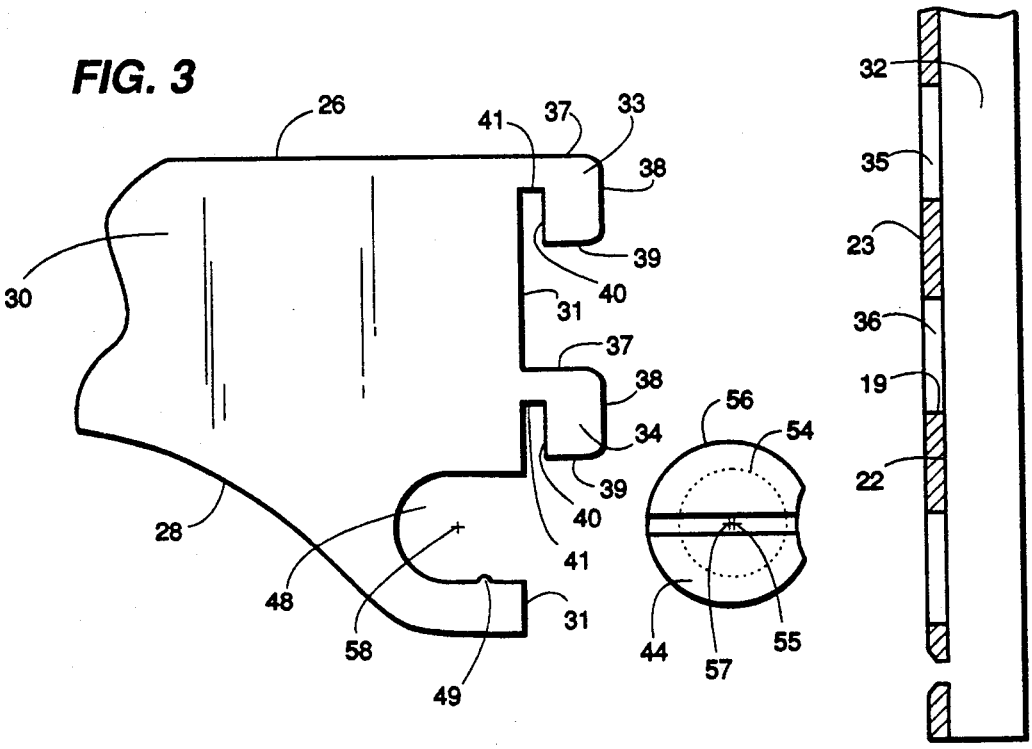
FIG. 3 is a fragmentary side elevational view of the eccentric disc lock bracket of the present invention illustrating the mounting or rear end of the cantilever bracket exploded from its eccentric disc lock and its vertical support member.

In the shelving system utilizing the embodiments of the present invention illustrated at FIG. 1. cantilever brackets 14 and 16 have a substantially planar upper edge 26 and lower tapered edge 28 terminating at their outermost end at retention stop 27. FIG. 3 illustrates the substantially planar upper edge 26 terminating at its support seating end into seating hook 33, and lower tapered edge 28 terminating at its support seating end at bracket rear edge 31.

Cantilever brackets 10 and 12 of FIG. 1. each have a seating end portion 30 illustrated in fragmentary side elevational view at FIG. 3. The present invention is addressed primarily to the seating end portion and its eccentric disc lock, it being understood that the body portion of the cantilever bracket can be fashioned with flanges, notches, apertures, arm or wing extensions and the like to accomplish other bracket purposes. FIG. 3 shows end portion 30 of a cantilever bracket of the present invention exploded from its eccentric disc lock 44 and vertical support member 32. End portion 30 is designed to be retained in cantilevered relation on support member 32 by two or more seating hooks outwardly extending from the rear edge 31 of the end portion of the cantilever bracket vertically positioned one above the other and dimensioned to be receivable in a pair of vertically spaced slots of the vertical support member such as slots 35 and 36 respectively. Upper seating hook 33 and lower seating hook 34 each include upper laterally extended portion 37, downwardly extended portion 38, lower laterally extended portion 39, upwardly extended planar portion 40, and inner laterally extending planar portion 41. The upper seating hook 33 and lower seating hook 34 are co-planar with respect to the cantilever bracket end portion 30 as well as co-planar with respect to each other. In this regard the entire bracket may be die punched or stamp pressed from a sheet of metal or other material and may be of substantial uniform thickness at all points.

FIG. 3 also illustrates a preferred embodiment eccentric disc lock 44 which is preferably an integral unit suitable for injection molding. The eccentric disc lock may be fabricated of a thermoplastic synthetic polymer such as polyurethane, polyethylene, polypropylene, polyamide, polyacetol, ABS (acrylonitrile-butadiene-styrene), thermoset plastics, fiberglass-filled resins, composites, metals and the like. Fabrication of the component may be achieved by injection molding, casting, extrusion, stamping, or screw machining.

Figure 6:
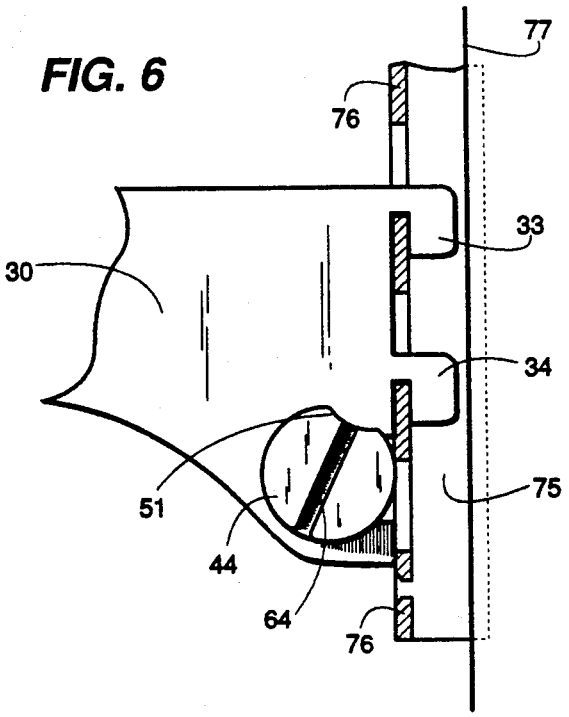
FIG. 6 is a fragmentary side elevational view of the eccentric disc lock bracket illustrating the same fully seated into a tubular vertical support member having a different outer wall thickness than that illustrated in FIG. 4 and FIG. 5 with the eccentric disc lock having been rotated counter-clockwise to a locked position.
Figure 7:
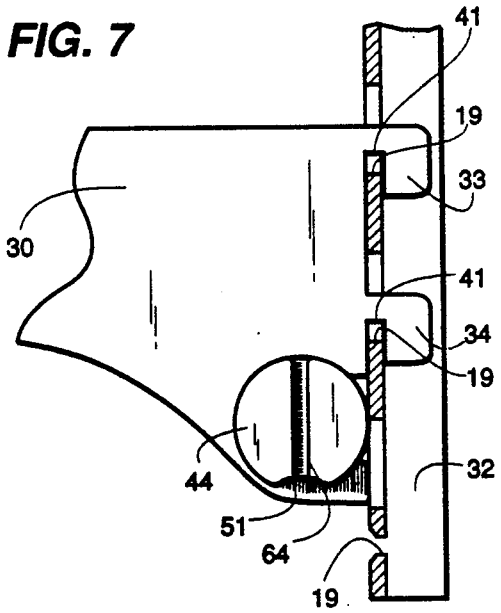
FIG. 7 is a fragmentary side elevational view of the eccentric disc lock bracket illustrating the seating hooks thereof locked in a partially seated fashion to the vertical support member.
Figure 8:
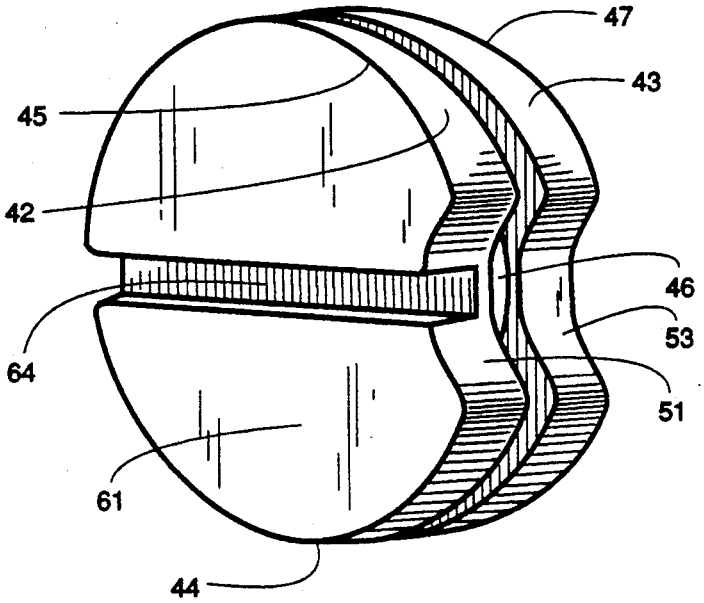
FIG. 8 is an enlarged perspective view of a preferred embodiment of the eccentric disc lock illustrating a turning groove in the outer surface of one wheel of the eccentric disc lock of sufficient width and length to have the side edge of a coin inserted therein for the purpose of rotating the eccentric disc lock in clockwise and/or counter-clockwise direction.
Figure 9:
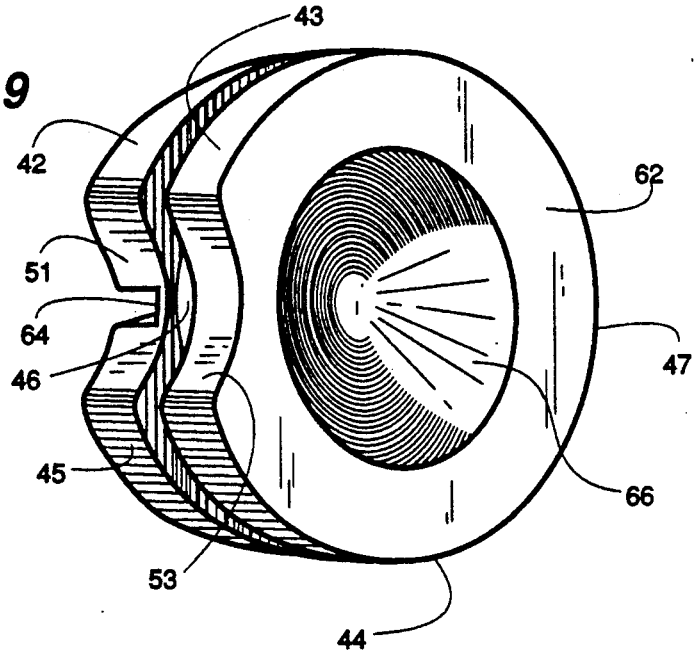
FIG. 9 is an enlarged perspective view of the reverse side of the preferred embodiment eccentric disc lock illustrated in FIG. 8 illustrating at least part of the outer surface of the other wheel being spherically concave.
Figure 10:
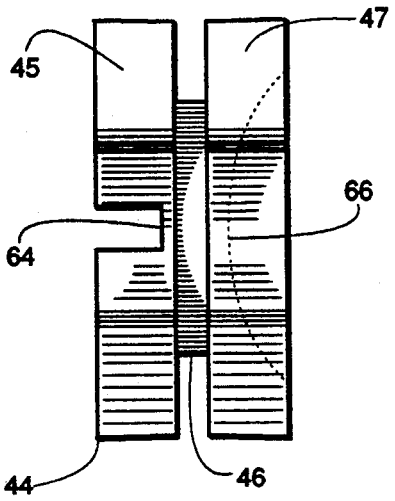
FIG. 10 is an enlarged end view of the preferred embodiment of the eccentric disc lock illustrated at FIG. 8 and FIG. 9.

The preferred embodiment eccentric disc lock 44 of FIG. 3 is also illustrated in the side elevational views of FIGS. 4, 5, 6, and 7, as well as in the enlarged perspective views of FIGS. 8 and 9 and the enlarged end view of FIG. 10. Alternative embodiments of the eccentric disc lock are shown in FIGS. 11, 12, 13, 14, and 15.

Discussing the preferred embodiment eccentric disc lock 44 first, enlarged FIGS. 8, 9, and 10 illustrate lock 44 having of a pair of wheels 45 and 47 joined by axle 46. As best observed in the exploded view of FIG. 3, axle 46 is held in fixed and rotatable retention in axle retention notch 48 by retention nub 49. Retention notch 48 is of a diameter corresponding to the diameter of axle 46 to permit the axle to rotate clockwise and/or counter-clockwise within retention notch 48 while securely held therein by retention nub 49. The axle 46 is force fitted during manufacture over retention nub 49 into retention notch 48. Wheels 45 and 47 are axially aligned to each other, of essentially alike diameter, positioned on opposite ends of the axle, and spaced apart from each other a distance slightly greater than the thickness of the cantilever bracket in which axle 46 is retained. Wheels 45 and 47 have outer annular aligned periphery 42 and 43 respectively. In the preferred embodiment (see FIGS. 3 to 10) of the eccentric disc lock, wheels 45 and 47 include outer annular periphery notch 51 and 53 respectively to their outer annular aligned periphery 42 and 43 respectively. Notches 51 and 53 are adjacent and axially aligned to each other. At least one of the wheels 45 or 47 has means for rotating the eccentric disc lock in clockwise and/or counter-clockwise direction to bracket lock and bracket unlock positions. These positions are achieved since the diameter of the eccentric disc lock axle is eccentric to the diameter of the pair of wheels. In the lock position a portion of the outer annular aligned periphery 42 and 43 of each wheel extends outwardly beyond rear edge 31 of end portion 30 of the cantilever bracket to compressively engage a support member; however, in the unlock position no such compressive engagement takes place as the eccentricity of the lock axle diameter to the wheel diameters thereby prevents another portion of outer annular aligned periphery 42 and 43 of each wheel (the notches 51 and 53 in the preferred embodiment of the eccentric disc lock) from extending outwardly beyond the rear edge 31 of cantilever bracket end portion 30 to engage the support member. In this regard axle retention notch 48 and retention nub 49 at FIG. 3 are each of a lateral depth into end portion 30 of the cantilever bracket to allow the eccentric axle diameter to both be retained therein and achieve a rotation of the outer annular aligned periphery of each wheel to the aforesaid lock and unlock positions. Such a position is illustrated at FIG. 3 by axle retention centerline 58.

Figure 11:
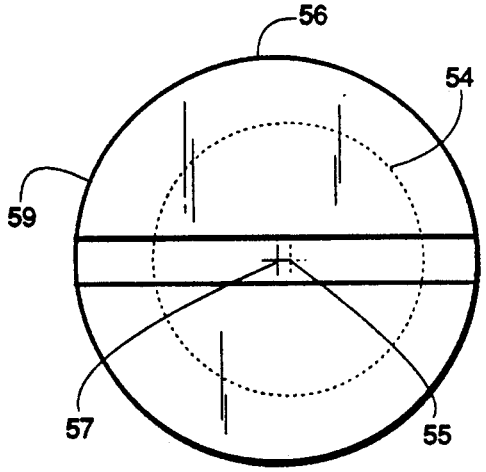
FIG. 11 is an enlarged side elevational view of another embodiment of the eccentric disc lock illustrating a turning groove in the outer surface of one wheel of the eccentric disc lock and illustrating the axle of the eccentric disc lock having a diameter eccentric to the diameter of the pair of wheels.

FIGS. 3 and 11 illustrate the eccentric diameters of the eccentric disc lock axle and wheels. In both figures axle diameter 54 is positioned eccentric or laterally offset to the aligned wheel diameters 56 with centerline 55 of the axle diameter offset from the centerline 57 of the aligned wheels' diameter. As used herein centerlines are symbolized by crosses and represent a grouping of all centerpoints. The degree of eccentricity of the axial diameter to the wheel diameters should be within a range to limit mechanical efficiency (the ratio of the distance the outer annular aligned periphery travels to the movement caused by the displacement of the eccentric center) to less than fifty percent thereby ensuring a self locking eccentric disc lock. The mechanical advantage ratio (the incremental distance traveled by a point on the outer wheel diameter divided by the distance moved due to the eccentric center displacement by an incremental rotation of the eccentric disc lock assembly) preferrrably provides a ratio of 11:1 or greater. In the preferred embodiment of the eccentric disc lock 44, axle diameter 54 is 0.488 inches offset laterally 0.038 inches from 0.818 inches wheel diameters 56.

In FIG. 3 preferred embodiment eccentric disc lock 44 has axle diameter 54 eccentric from wheel diameters 56 toward the outer annular aligned periphery notches 51 and 53 of the wheels. Axle diameter centerline 55 is parallel to the centerline 57 of the wheels' diameter and is in the same plane as the centerline of the notches in the outer annular aligned periphery of each wheel. FIG. 11 is an enlarged side elevational view of an alternative embodiment illustrating eccentric disc lock 59 having axle diameter 54 eccentric to aligned wheel diameters 56. Axle centerline 55 is parallel to centerline 57 of both wheels. Eccentric disc lock 59 has full circular outer annular periphery to both wheels not interrupted by notches 51 and 53 as in eccentric disc lock 44 of the preferred embodiment. When rotated in a axle retention notch or aperature of an end portion of the cantilever bracket of the present invention, eccentric disc lock 59 is similiar to eccentric disc lock 44 in lock and unlock position; a lock position is charactorized by a portion of the outer annular aligned periphery of each wheel extending outwardly beyond rear edge 31 of end portion 30 of the bracket to compressingly engage a support member and an unlock position is charactorized by another portion of the outer annular aligned periphery of each wheel not extending outwardly beyond the rear edge 31 of end portion 30 of the bracket when disposed perpendicular to the support member thereby failing to engage the support member. The eccentric nature of the axial diameter to the wheel diameters allows the fully circular outer annular aligned periphery of each wheel of alternative embodiment eccentric disc lock 59 to lock and unlock a cantilevered bracket of the present invention. Nevertheless, the turning groove terminating into a notch arrangement of eccentric disc lock 44 is preferred primarily for advantageously giving the eccentric disc lock bracket user a readily observable visual reference of the lock and unlock positions.

In this regard eccentric disc lock 44 enlarged at FIGS. 8, 9, and 10 illustrate the same separated from its environment of a cantilever bracket. FIG. 8 is a side elevational view illustrating wheel 45 of eccentric disc lock 44 having a turning groove 64 in its outer surface 61 terminating in the center of periphery notch 51. Groove 64 is illustrated as being fully across the wheel 45 however it is noted that groove 64 need only be of sufficient width and length to allow a coin to be inserted therein by a user of the eccentric disc lock bracket to rotate the eccentric disc lock in either clockwise or counter clockwise direction. Groove 64 and notch 51 cooperate to provide a readily accessible visual reference point to the user of the eccentric disc lock 44 to determine whether the disc lock is in locked or unlocked position. When groove 64 and notch 51 are perpendicular to the support member the unlocked position is quickly ascertained. When eccentric disc lock 44 is rotated in clockwise or counter-clockwise direction to achieve a locking position, groove 64 and notch 51 are no longer perpendicular to the support member to thereby define a lock position readily observant to a user.

FIG. 9 is an enlarged perspective view of the reverse side of eccentric disc lock 44 illustrated at FIG. 8. showing the outer side surface 62 of wheel 47 at least partially spherically concave at spherical concavity 66 to decrease the cost of mold injection manufacture of the eccentric disc lock by lessening the time necessary to mold the same and dissipating heat out of the integral part quicker.

FIG. 10 is an enlarged end view of eccentric disc lock 44 illustrated a FIGS. 8 and 9.

Figure 4:
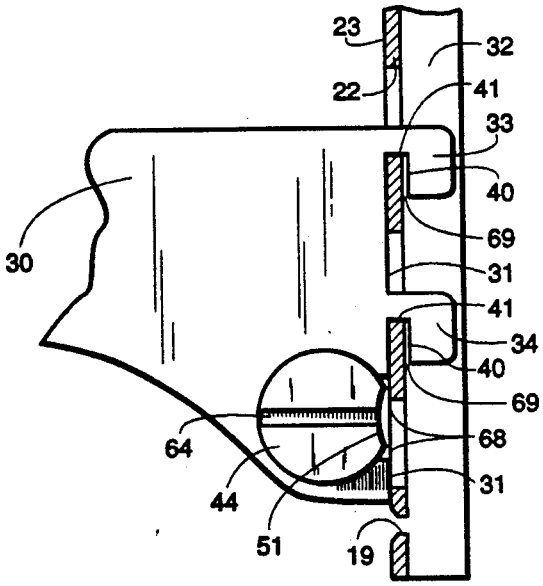
FIG. 4 is a fragmentary side elevational view of the eccentric disc lock bracket illustrating the same fully seated in a vertical support member with the eccentric disc lock in an unlocked position.

Referring now to FIG. 4, there is illustrated a fragmentary side elevational view of cantilever bracket end portion 30 mounted in vertical support member 32 with upper seating hook 33 and lower seating hook 34 "fully seated" into receiving slots of the vertical support member but with eccentric disc lock 44 in an unlocked position wherein groove 64 terminating into the center of notch 51 are both perpendicular to outer surface 23 of support member bracket facing plate 22. The wheel notches 51 and 53 of eccentric disc lock 44 do not extend outwardly beyond the rear edge 31 of end portion 30 of the bracket when disposed perpendicular to vertical support member 32, thus FIG. 4 further illustrates gap 68 between outer surface 23 of support member bracket facing plate 22 and wheel notch 51.

Figure 2:
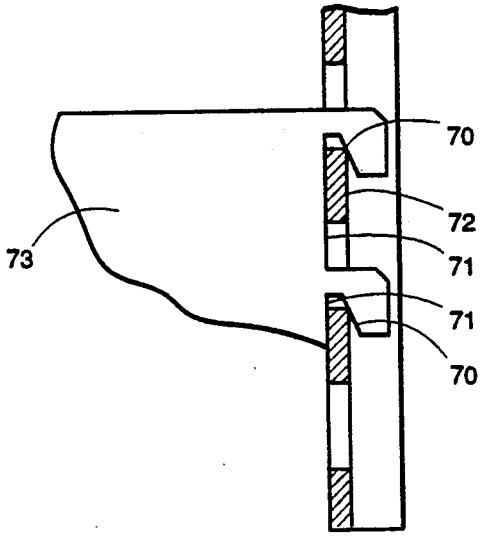
FIG. 2 is a fragmentary side elevational view illustrating a prior art angled-edged seating hook force fitted to a vertical support member.

FIG. 4 also illustrates gap clearance 69 between rear face plate surface 24 and upwardly extended planar portion 40 of upper seating hook 33 and lower seating hook 34. This clearance accrues from the fact that seating hooks 33 and 34 can accommodate the thickness of support member bracket facing plate 22 as that thickness is less than the length of inner laterally extended planar portion 41 of hooks 33 and 34. This fact is significant for the ease of installation and removal of the eccentric disc lock bracket of the present invention; no force is necessary to seat inner laterally extended planar portion 41 of seating hooks 33 and 34 onto upper edge 19 of bracket facing plate 22. Certain prior art seating flanges of the type illustrated at FIG. 2 having an angled seating hook edge 70 require force-fitting installation, typically by hammer blows, to pinch capture bracket facing plate 72 between angled seating hook edge 70 and rear edge 71 of prior art cantilever bracket end portion 73. Force fitting is best avoided as the same often requires tools, can scar, chip, or damage the finish or color coating of both the cantilever bracket and support member harming the ornamental appearance important in home decor and commerical display bracket structures, and may even endanger the structural integrity of a bracket/support member system by angled seating edge shearing or damaging of the edge's support surface. Gap clearance 69 allows gravity to seat the eccentric disc lock bracket of the present invention with zero insertion force. The only force required is the locking force applied to the means for rotating the eccentric disc lock not an insertion force for seating of the cantilever bracket.

Figure 5:
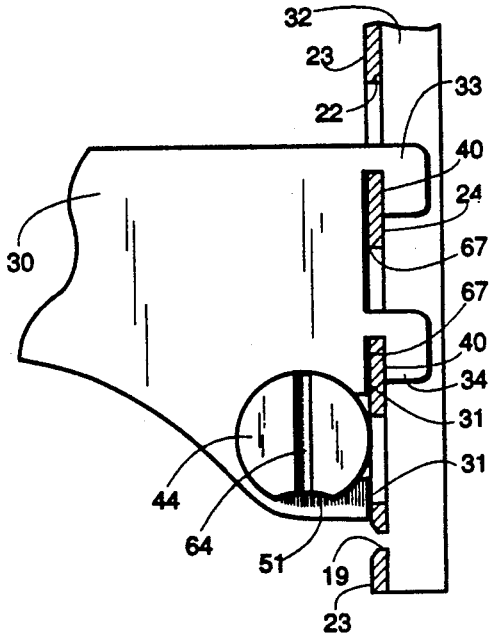
FIG. 5 is a fragmentary side elevational view of the eccentric disc lock bracket illustrating the same fully seated in a vertical support member with the eccentric disc lock having been rotated clockwise to a locked position.

FIG. 5 is a fragmentary side elevational view similar to that of FIG. 4 but now illustrating the eccentric disc lock 44 in a locked position after being rotated clockwise to point notch 51 downward of bracket facing plate 22 of the vertical support member 32. As eccentric disc lock 44 is rotated, the eccentricity of the axle diameter to the wheel diameters causes with each degree of rotation a torque to be amplified into an increasing horizontal clamping force applied to outer annular aligned periphery 42 and 43 of wheels 45 and 47 respectively against the bracket facing plate 22 of support member 32 to compressingly force rear face plate surface 24 in abuttment with upwardly extended planar portion 40 of seating hooks 33 and 34. Lock gap 67 between rear edge 31 of cantilever bracket end portion 30 and outer face plate surface 23 results from such locking due to the thickness of face plate 22 being less than the length of inner laterally extended planar portion 41 of hooks 33 and 34.

FIG. 6 is a fragmentary side elevational view of end portion 30 of the eccentric disc lock bracket fully seated into a tubular shaped vertical support member 75 having a different bracket facing plate thickness than that illustrated in FIGS. 4 and 5 showing eccentric disc lock 44 again in locked position but this time after turning groove 64 has been rotated counter-clockwise to point notch 51 upward relative to new support member face plate 76. Groove 64 and notch 51 again give instant visual reference that the bracket is held in locked position. Tubular support member 75 is secured to the back of wall 77. Bracket end portion 30 still seats upon new face plate 76 which is of greater thickness than that illustrated in FIG. 4 and FIG. 5. but a locking position of eccentric disc lock 44 is achieved with less rotation of groove 64 and notch 51 from their perpendular to face plate unlocked position due to the increased new face plate 76 thickness.

It is advantageous that the eccentric disc lock bracket of the present invention accommodates face plates of differing thicknesses. Face plate of support members may be made of a variety of materials and in different thicknesses which customarily range from 0.047 inches to 0.093 inches for most household purpose vertical support members and 0.094 inches to 0.140 inches for most commercial purpose vertical support members. Regardless of the difference in face plate thickness or material used an appropriately dimensioned eccentric disc lock bracket of the present invention can accommodate the same and achieve lock and unlock positions with the attendant advantages described herein. For example, inner laterally extended planar portion 41 of seating hooks 33 and 34 illustrated at FIG. 3 can be dimensioned according to whether the cantilever bracket will be used for household or commercial purposes or may be designed for still greater length if bracket needs require. A inner laterally extended planar portion 41 for bracket seating hooks 33 and 34 outwardly extending from the rear edge of the cantilever bracket a distance of 0.094 inches is appropriate for most household shelving needs however, the inner laterally extended planar portion of the pair of seating hook members may be extended outward from the rear edge of the cantilever bracket arm a distance of 0.140 inches for most commercial display needs.

The eccentric disc lock 44 can be rotated over 300 degrees (i.e. 360 degrees less notch radius) to achieve a locking position. The fully circular outer annular periphery eccentric disc lock 59 can be rotated a full 360 degrees to achieve a locking position. With a face plate of medium thickness the locking position may be achieved at approximately a 90 degree turn from the unlock position perpendicular to the support member. Such is illustrated in FIG. 5 and FIG. 7. However if the vertical support member has a face plate of greater than average thickness then the eccentric disc lock may securely lock with a 15 degree to 75 degree rotation from the unlocked position. A vertical support member of less than average thickness may require a rotation from the unlocked position of 120 degrees to 160 degrees.

FIG. 5 and FIG. 6 also illustrate the principal that the eccentric disc lock of the present invention can be rotated in either direction to achieve a lock securement of the bracket to vertical support member.

FIG. 7 is a fragmentary side elevational view similar to FIG. 5 except there is illustrated therein a locked securement of upper seating hook 33 and lower seating hook 34 to the vertical support member in only a partially seated position wherein the inner laterally extended planar portion 41 of the seating hooks 33 and 34 do not rest upon a supporting edge 19 of face plate 22 of the vertical support member 32. Thus, the present invention advantageously allows for slight vertical adjustments to the locking position of a cantilever bracket into its vertical support member. However, locking seating hooks to a vertical support member in only a partially seated position may adversely affect the stress bearing capacity of the cantilever arm.

Figure 15:
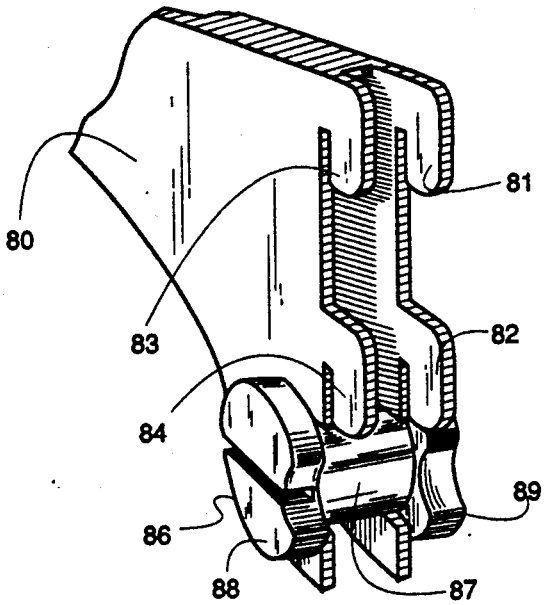
FIG. 15 is a perspective end view of another embodiment of the eccentric disc lock cantilever bracket illustrating a cantilever bracket of greater thickness than that shown in the previous figures having four seating hooks outwardly extending from a rear edge of the end portion of the cantilever bracket, a pair of seating hooks at each side vertically positioned one above the other, all of which hooks are dimensioned to be receivable in a pair of vertically spaced slots of sufficient horizontal width of a support member. The eccentric disc lock to such a cantilever bracket has a wider axle and a pair of wheels axially aligned to each other of identical diameter at opposite ends of the axle spaced apart from each other a distance greater than the thickness of the cantilever bracket.

FIG. 15 is an end perspective view of another type of eccentric disc lock bracket utilizing the principals of the present invention. In this embodiment cantilever bracket end portion 80 is of greater thickness as viewed from the end than the cantilever bracket end portion 30 previously illustrated. Further, bracket end portion 80 has four seating hooks 81, 82, 83, 84, outwardly extending from a rear edge of the end portion of the cantilever bracket, a pair of seating hooks at each end side vertically positioned one above the other. These seating hooks are dimensioned to be receivable in a pair of vertically spaced slots of sufficient horizontal width in a vertical support member. In this particular embodiment eccentric disc lock 86 has an axle 87 of a wider length than that illustrated for example at FIG. 10 such as to space apart a pair of wheels 88 and 89 of identical diameter on opposite ends of the axle 87 from each other a distance greater than the increased thickness of this particular cantilever bracket.

Figure 12:
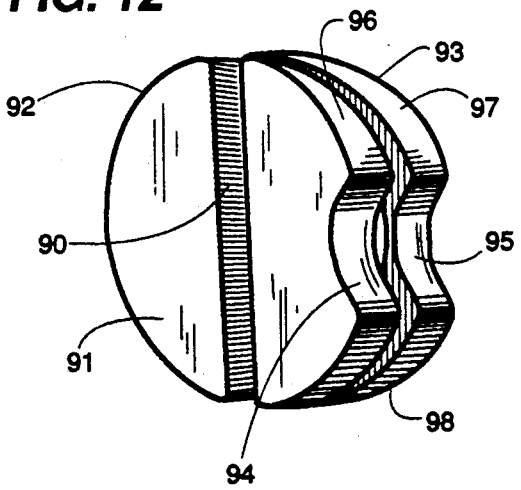
FIG. 12 is an enlarged perspective side view of another embodiment of the eccentric disc lock illustrating a turning groove on the outer surface of one wheel set apart from the notch on the outer periphery of said wheel.
Figure 13:
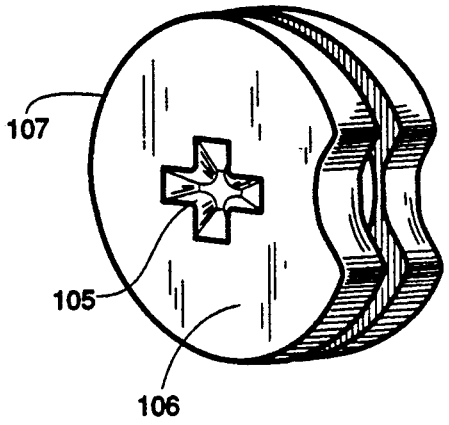
FIG. 13 is an enlarged perspective side view of another embodiment of the eccentric disc lock illustrating a phillips-screw driver type indentation in the outer surface of one wheel to compliment the use of a phillips-screw driver to rotate the eccentric disc lock in clockwise and/or counter-clockwise direction.
Figure 14:
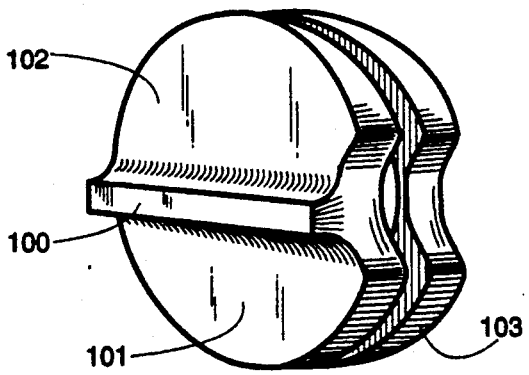
FIG. 14 is an enlarged perspective side view of another embodiment of the eccentric disc lock illustrating a turning knob projecting from the outer surface of one wheel which can be grasped by a user of the eccentric disc lock bracket to turn the eccentric disc lock in clockwise and/or counter-clockwise direction.

In FIGS. 12, 13, and 14 there is illustrated alternative embodiments of the eccentric disc lock providing different means for rotating the eccentric disc lock in a clockwise and counter-clockwise direction. In FIG. 12 groove 90 in the outer surface 91 of wheel 92 of eccentric disc lock 93 is set apart from notches 94 and 95 in the outer annular wheel periphery 96 and 97 of wheels 92 and 98 respectively. Thus, it is not necessary to groove the outer surface of an eccentric disc lock wheel such as to terminate the groove to the center point of a notch in the outer annular periphery of a wheel as illustrated in FIG. 8. Indeed, a groove on the outer surface of wheel 92 need not run the entire diameter of the wheel, but need only be of sufficient width and length to enable the side edge of a coin or screw driver to be inserted therein for the purpose of rotating the eccentric disc lock in either clockwise or counter-clockwise direction.

In FIG. 14 there is illustrated a turning knob 100 projecting from outer surface 101 of wheel 102 of the eccentric disc lock 103 which may be grasped by a user to turn the knob to rotate the wheel in clockwise and/or counter-clockwise direction.

FIG. 13 illustrates yet another embodiment of the eccentric disc lock wherein the means for rotating the same comprises a phillips-screw driver indentation 105 in the outer surface 106 of wheel 107 to complimentarily receive the head of a phillips-screw driver for rotating the eccentric disc lock. Although the illustrated indentation of FIG. 13 is that complimentary to a phillips-screw driver it is readily apparent to those skilled in the art that the indentation may take other forms complimentary to other tools suitable for turning the eccentric disc lock.

The term "notch" or its plural as used with reference to outer annular aligned periphery (circumference) of a wheel or wheels of the eccentric disc lock disclosed in this specification and the patent claims herein is specifically hereby defined as an indentation to the circumference of the wheel or wheels, said term encompassing a flattening of the diameter as well as a more severe indentation with or without a radius.

It is believed that the eccentric disc lock bracket of the present invention in its described embodiments and with its numerous attended advantages will be fully understood from the foregoing description, and that changes may be made in form, construction, and arrangement of the several parts thereof without departing from the spirit or scope of the invention, or sacrificing any of the attendant advantages. The structures herein disclosed are preferred embodiments for the purpose of illustrating the invention in order to best explain the principals of the invention and its application and practical use to thereby enable others to utilize the invention. The preferred embodiments illustrated is not intended to be exhaustive or to limit the invention to the precise form disclosed. Accordingly, the scope of the invention is only to be limited as necessitated by the accompanying claims.

We claim:

1. An eccentric disc lock bracket for releasable engagement with a support member having a plurality of vertically spaced slots comprising:

A. a cantilever bracket including an end portion having an axle receiving aperture and at least two seating hooks outwardly extending from a rear edge of said end portion vertically positioned one above the other and dimensioned to be receivable in and horizontally removable from a pair of vertically spaced slots of said support member;

B. an eccentric disc lock having an annular axle which is force fitted over an interference retention nub on the outer periphery of said axle receiving aperture to thereby permanently retain said axle in said axle receiving aperture of said bracket end portion for all 360 degrees of rotational positions of said axle when so force fitted over said retention nub thus preventing removal or loss of said eccentric disc lock from said axle receiving aperture of said bracket end portion and causing said eccentric disc lock to be unitary with said cantilever bracket, said axle capable of being unidirectionally rotated either in a clockwise or counter-clockwise direction to achieve a lock position, and a pair of wheels axially aligned to each other having an essentially alike diameter greater than the diameter of said axle receiving aperture, said wheels being located on opposite ends of the axle spaced apart from each other a distance greater than the thickness of said cantilever bracket, at least one wheel having means for rotating the eccentric disc lock either in a clockwise or counter-clockwise direction to said lock position wherein a portion of the outer annular aligned periphery of each wheel extends outwardly beyond the rear edge of said end portion of said bracket to compressingly engage said support member and to an unlock position wherein another portion of the outer annular aligned periphery of each wheel does not extend outwardly beyond the rear edge of said end portion of said bracket when disposed perpendicular to said support member, said axle having a diameter eccentric to the diameter of said pair of wheels.

2. The eccentric disc lock bracket as recited in claim 1 wherein at least part of the outer side of one wheel of the eccentric disc lock is spherically concave.

3. The eccentric disc lock bracket as recited in claim 1 wherein said means for rotating the eccentric disc lock comprises at least one wheel having a groove to its outer side surface of sufficient width and length to have the side edge of a coin inserted therein for the purpose of rotating the eccentric disc lock in either clockwise or counter-clockwise direction.

4. The eccentric disc lock bracket as recited in claim 1 wherein said means for rotating the eccentric disc lock comprises at least one wheel having an indentation in its outer side surface to complimentarily receive a screw driver or other tool for the purpose of rotating the eccentric disc lock in either clockwise or counter-clockwise direction.

5. The eccentric disc lock bracket as recited in claim 1 wherein said means for rotating the eccentric disc lock comprises at least one wheel having a turning knob projecting perpendicular from its outer side surface.

6. The eccentric disc lock bracket as recited in claim 1 wherein the end portion of the cantilever bracket has an axle receiving aperture located beneath at least two seating hooks outwardly extending from a rear edge of the end portion of the cantilever bracket vertically positioned one above the other.

7. The eccentric disc lock bracket as recited in claim 1 wherein at least two seating hooks outwardly extending from said rear edge of said end portion of the cantilever bracket have an upper laterally extended portion, a downwardly extended portion, an outer laterally extended portion, an upwardly extended planar portion, and an inner laterally extended planar portion.

8. The eccentric disc lock bracket as recited in claim 7 wherein said inner laterally extended planar portion of at least two seating hooks can seat upon a support member having a bracket facing plate thickness of up to 0.094 inches.

9. The eccentric disc lock bracket as recited in claim 7 wherein said inner laterally extended planar portion of at least two seating hooks can seat upon a support member having a bracket facing plate thickness of up to 0.140 inches.

10. The eccentric disc lock bracket as recited in claim 7 wherein said inner laterally extended planar portion of at least two seating hooks can seat upon a support member having a bracket facing plate thickness of greater than 0.140 inches.

11. An eccentric disc lock bracket for releasable engagement with a support member having a plurality of vertically spaced slots comprising:

A. a cantilever bracket including an end portion having an axle receiving aperture and at least two seating hooks outwardly extending from a rear edge of said end portion vertically positioned one above the other and dimensioned to be receivable in and horizontally removable from a pair of vertically spaced slots of said support member;

B. an eccentric disc lock having an axle located in said axle receiving aperture of said bracket end portion, said axle capable of being rotated either in a clockwise or counter-clockwise direction to achieve a lock position, and a pair of wheels axially aligned to each other having an essentially alike diameter greater than the diameter of said axle receiving aperture, said wheel being located on opposite ends of the axle spaced apart from each other a distance greater than the thickness of said cantilever bracket, each wheel having a notch in its outer annular periphery adjacent and axially aligned to the other and at least one wheel having means for rotating the eccentric disc lock either in a clockwise or counter-clockwise direction to said lock position wherein a portion of the outer annular aligned periphery of each wheel extends outwardly beyond the rear edge of said end portion of said bracket to compressingly engage said support member and to an unlock position wherein said wheel notches do not extend outwardly beyond the rear edge of said end portion of said bracket when disposed perpendicular to said support member, said axle having a diameter eccentric to the diameter of said pair of wheels by being offset toward said notches while the centerlines of the axle and both wheel diameters are parallel to each other and in the same plane as the centerlines of said notches in the outer annular aligned periphery of each wheel, and said notch of each wheel defining a visual reference point to determine whether said eccentric disc lock bracket is in said locked or unlocked position.

12. The eccentric disc lock bracket as recited in claim 11 wherein at least part of the outer side of one wheel of the eccentric disc lock is spherically concave.

13. The eccentric disc lock bracket as recited in claim 11 wherein said means for rotating the eccentric disc lock comprises at least one wheel having a groove to its outer side surface of sufficient width and length to have the side edge of a coin inserted therein for the purpose of rotating the eccentric disc lock in either clockwise or counter-clockwise direction.

14. The eccentric disc lock bracket as recited in claim 11 wherein said means for rotating the eccentric disc lock comprises at least one wheel having a groove across its outer side surface terminating into said notch of the wheel, said groove being in the same plane as the centerline of said notch and having a sufficient width and length to have the side edge of a coin inserted therein for the purpose of rotating the eccentric disc lock either in a clockwise or counter-clockwise direction, said groove and notch defining a visual reference point to determine whether said eccentric disc lock bracket is in said locked or unlocked position.

15. The eccentric disc lock bracket as recited in claim 11 wherein said means for rotating the eccentric disc lock comprises at least one wheel having an indentation in its outer side surface to complimentarily receive a screw driver or other tool for the purpose of rotating the eccentric disc lock either in clockwise or counter-clockwise direction.

16. The eccentric disc lock bracket as recited in claim 11 wherein said means for rotating the eccentric disc lock comprises at least one wheel having a turning knob projecting perpendicular from its outer side surface.

17. The eccentric disc lock bracket as recited in claim 11 wherein at least two seating hooks outwardly extending from said rear edge of said end portion of the cantilever bracket have an upper laterally extended portion, a downwardly extended portion, an outer laterally extended portion, an upwardly extended planar portion, and an inner laterally extended planar portion.

18. The eccentric disc lock bracket as recited in claim 17 wherein said inner laterally extended planar portion of at least two seating hooks can seat upon a support member having a bracket facing plate thickness of up to 0.094 inches.

19. The eccentric disc lock bracket as recited in claim 17 wherein said inner laterally extended planar portion of at least two seating hooks can seat upon a support member having a bracket facing plate thickness of up to 0.140 inches.

20. The eccentric disc lock bracket as recited in claim 17 wherein said inner laterally extended planar portion of at least two seating hooks can seat upon a support member having a bracket facing plate thickness of greater than 0 140 inches.

21. The eccentric disc lock bracket as recited in claim 17 wherein the upwardly extended planar portion of at least two seating hooks are locked to a vertical support member without the inner laterally extended planar portion of said seating hooks being fully seated on a supporting edge of the vertical support member.

22. The eccentric disc lock bracket as recited in claim 11 wherein the end portion of the cantilever bracket has an axle receiving aperture located beneath at least two seating hooks outwardly extending from a rear edge of the end portion of the cantilever bracket vertically positioned one above the other.

23. The eccentric disc lock bracket as recited in claim 11 wherein the axle is force fitted over a retention nub on the outer periphery of said axle receiving aperture and retained in said axle receiving aperture of said bracket end portion.

* * * * *